US008533882B2

(12) United States Patent
Lilie

(10) Patent No.: US 8,533,882 B2
(45) Date of Patent: Sep. 17, 2013

(54) LAUNDRY TREATING APPLIANCE WITH CONTROLLED OSCILLATING MOVEMENT

(75) Inventor: Dietmar E. Lilie, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 903 days.

(21) Appl. No.: 12/622,642

(22) Filed: Nov. 20, 2009

(65) Prior Publication Data

US 2011/0119839 A1 May 26, 2011

(51) Int. Cl.
*D06F 33/00* (2006.01)

(52) U.S. Cl.
USPC ..... 8/159; 68/12.01; 68/12.02; 68/12.16

(58) Field of Classification Search
CPC ..... D06F 37/20; D06F 37/203; D06F 37/206
USPC ..... 8/159; 68/12.02, 12.16
See application file for complete search history.

(56) References Cited

U.S. PATENT DOCUMENTS

| | | | | |
|---|---|---|---|---|
| 4,412,284 | A * | 10/1983 | Kerforne et al. | 714/22 |
| 4,843,671 | A * | 7/1989 | Hirooka et al. | 8/159 |
| 5,432,969 | A | 7/1995 | Oh | |
| 5,450,733 | A | 9/1995 | Kim et al. | |
| 5,505,063 | A | 4/1996 | Kim et al. | |
| 5,507,054 | A * | 4/1996 | Blauert et al. | 8/159 |
| 5,795,630 | A * | 8/1998 | Shapiro | 428/13 |
| 8,381,569 | B2 * | 2/2013 | Lilie et al. | 73/1.37 |
| 2003/0101519 | A1 * | 6/2003 | Gayme et al. | 8/159 |
| 2005/0283919 | A1 * | 12/2005 | Kim | 8/158 |
| 2007/0294838 | A1 * | 12/2007 | Croxton | 8/158 |

FOREIGN PATENT DOCUMENTS

| | | | |
|---|---|---|---|
| KR | 20040090337 A | * | 4/2003 |
| KR | 20040090337 A | | 10/2004 |

OTHER PUBLICATIONS

KR20040090337A—Machine Translation.*

* cited by examiner

*Primary Examiner* — Michael Kornakov
*Assistant Examiner* — Marc Lorenzi
(74) *Attorney, Agent, or Firm* — Clifton G. Green; McGarry Bair PC

(57) ABSTRACT

Disclosed is a laundry treating appliance having a drum and a torsionally flexible drive mechanism. The drum simultaneously rotates in a first rotational direction and oscillates about an axis of rotation.

10 Claims, 9 Drawing Sheets

LAUNDRY TREATING APPLIANCE WITH CONTROLLED OSCILLATING MOVEMENT

BACKGROUND OF THE INVENTION

A laundry treating appliance is a common household device for treating laundry in accordance with a preprogrammed treating cycle of operation. A subset of laundry treating appliances use a generally horizontally rotating drum to define a chamber in which the laundry is received for treatment according to the cycle of operation. The drum may be rotated at a predetermined speed in a predetermined direction as required by the cycle. Some laundry treating appliances may reverse and/or oscillate the direction of rotation in accordance with the preprogrammed cycle. The rotation of the drum may be used to impart mechanical action to the laundry, which may be attributable to the lifting and falling of the laundry as the drum is rotated and/or the relative sliding of individual laundry items.

The mechanical action associated with the horizontally rotating drum is relative low compared to other types of laundry appliances. Given that thermal action, chemical action, and mechanical action are the three primary sources of cleaning action for the laundry, a laundry treating appliance with a relatively low mechanical action will need to have greater thermal action and/or chemical action to obtain the same degree of cleaning.

BRIEF DESCRIPTION OF THE INVENTION

In one aspect, the invention is a laundry treating appliance and a method of operating the laundry treating appliance, the appliance having a drum rotatable about an axis of rotation; an electric motor having a rotor; a torsionally flexible drive mechanism coupling the rotor with the drum such that rotation of the motor effects a rotation of the drum; and a controller operably coupled with the motor and configured to supply a control signal to the motor to effect a rotation of the drum comprising a simultaneous general rotation in a first rotational direction and a oscillation about an axis of rotation.

DESCRIPTION OF AN EMBODIMENT OF THE INVENTION

Figure 1:
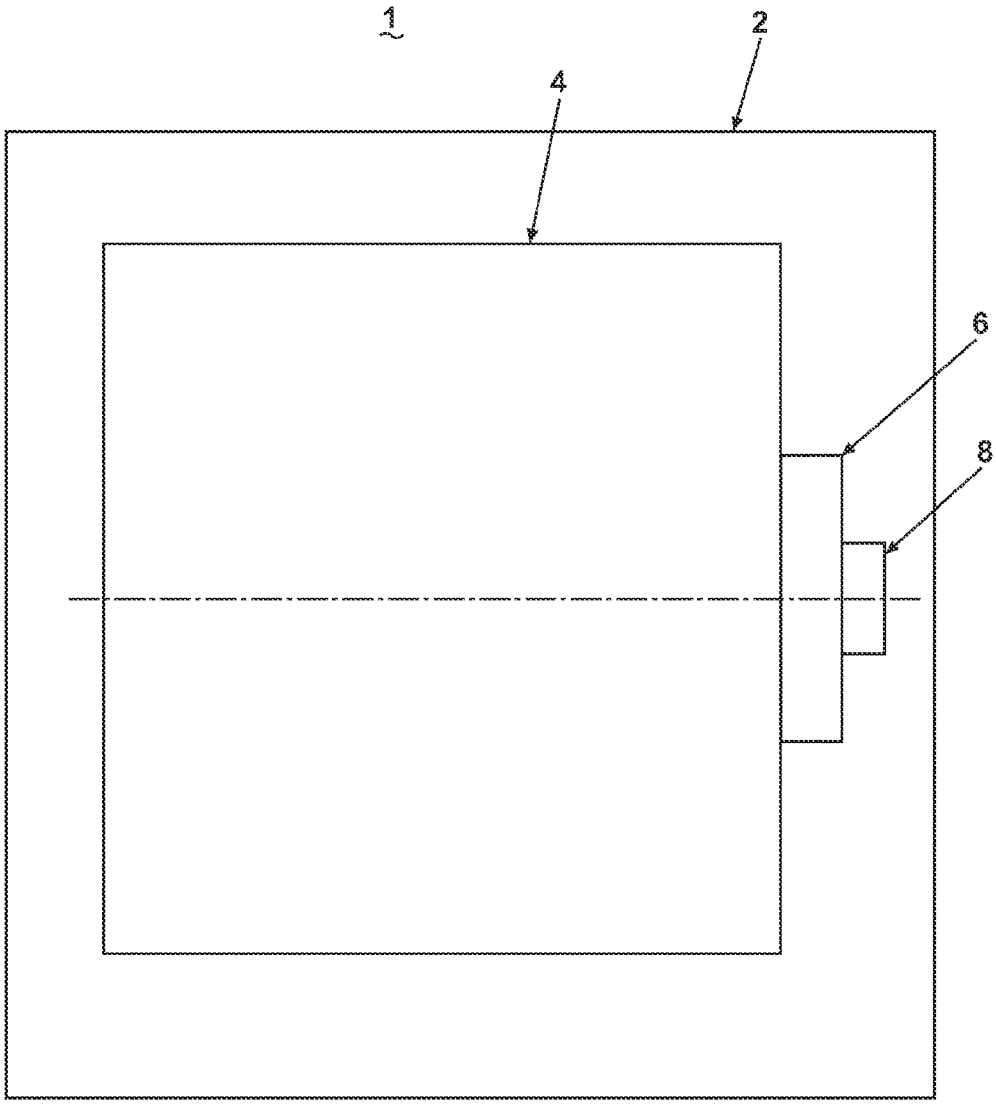
FIG. 1 is a schematic view of a laundry treating appliance according to a first embodiment of the invention.

Referring now to the figures, FIG. 1 is a schematic view of a laundry treating appliance 1 according to a first embodiment of the invention. The laundry treating appliance 1 and methods described herein may be used with any suitable laundry treating appliance, such as any machine that treats fabrics, and examples of the laundry treating appliance may include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing/revitalizing machine; an extractor; a non-aqueous washing apparatus; and a revitalizing machine.

For illustrative purposes, the different embodiments will be described with respect to a washing machine with the fabric being a laundry load, with it being understood that the invention may be used with other types of laundry treating appliances for treating fabric. The laundry treating appliance 1 may have a stationary tub 2, a drum 4 rotatable about an in at least one of rotational directions about an axis of rotation, an oscillation mechanism 6 rotationally oscillating the drum 4 about the axis of rotation and a motor 8 operably coupled with the drum 4 to rotate the drum 4 at various speeds in either a first rotational direction and a second rotational direction, opposite the first rotational direction. The oscillating mechanism 6 may be couple with the motor 8 and/or may couple the motor 8 with the drum 4. Shown configuration of the laundry treating appliance 1 oscillates the drum 4 about the axis of rotation while the drum 4 is being rotated at the predetermined operating speed.

Washing machines are typically categorized as either a vertical axis washing machine or a horizontal axis washing machine. As used herein, the "vertical axis" washing machine refers to a washing machine having a rotatable drum that rotates about a generally vertical axis relative to a surface that supports the washing machine. In some vertical axis washing machines, the drum rotates about a vertical axis generally perpendicular to a surface that supports the washing machine. However, the rotational axis need not be perfectly vertical or perpendicular to the surface. The drum can rotate about an axis inclined relative to the vertical axis. As used herein, the "horizontal axis" washing machine refers to a washing machine having a rotatable drum that rotates about a generally horizontal axis relative to a surface that supports the washing machine. In some horizontal axis washing machines, the drum rotates about a horizontal axis generally parallel to a surface that supports the washing machine. However, the rotational axis need not be perfectly horizontal or parallel to the surface. The drum can rotate about an axis inclined relative to the horizontal axis, with fifteen degrees of inclination being one example of inclination.

In the laundry treating appliance 1, the laundry is cleaned by three main sources of energy: chemical, thermal, and mechanical. Mechanical energy can further be divided into two components: clothes-to-clothes friction and the falling action associated with the tumbling of clothes due to the rotation of the drum 4. Depending on the various characteristics of the treating appliance 1, such as the size of the drum 4, the size of the laundry load, and the control signal, the rotation of the drum 4 may result in various types of laundry load movement inside the drum 4. For example, the laundry load may undergo at least one of tumbling, rolling (also called balling), sliding, satellizing (also called plastering), and combinations thereof. During tumbling, the fabric items in the drum 4 rotate with the drum 4 from a lowest location of the drum 4 towards a highest location of the drum 4, but fall back to the lowest location before reaching the highest location. The terms tumbling, rolling, sliding and satellizing are terms of art that may be used to describe the motion of some or all of the fabric items forming the laundry load. However, not all of the fabric items forming the laundry load need exhibit the motion for the laundry load to be described accordingly.

Figure 2:
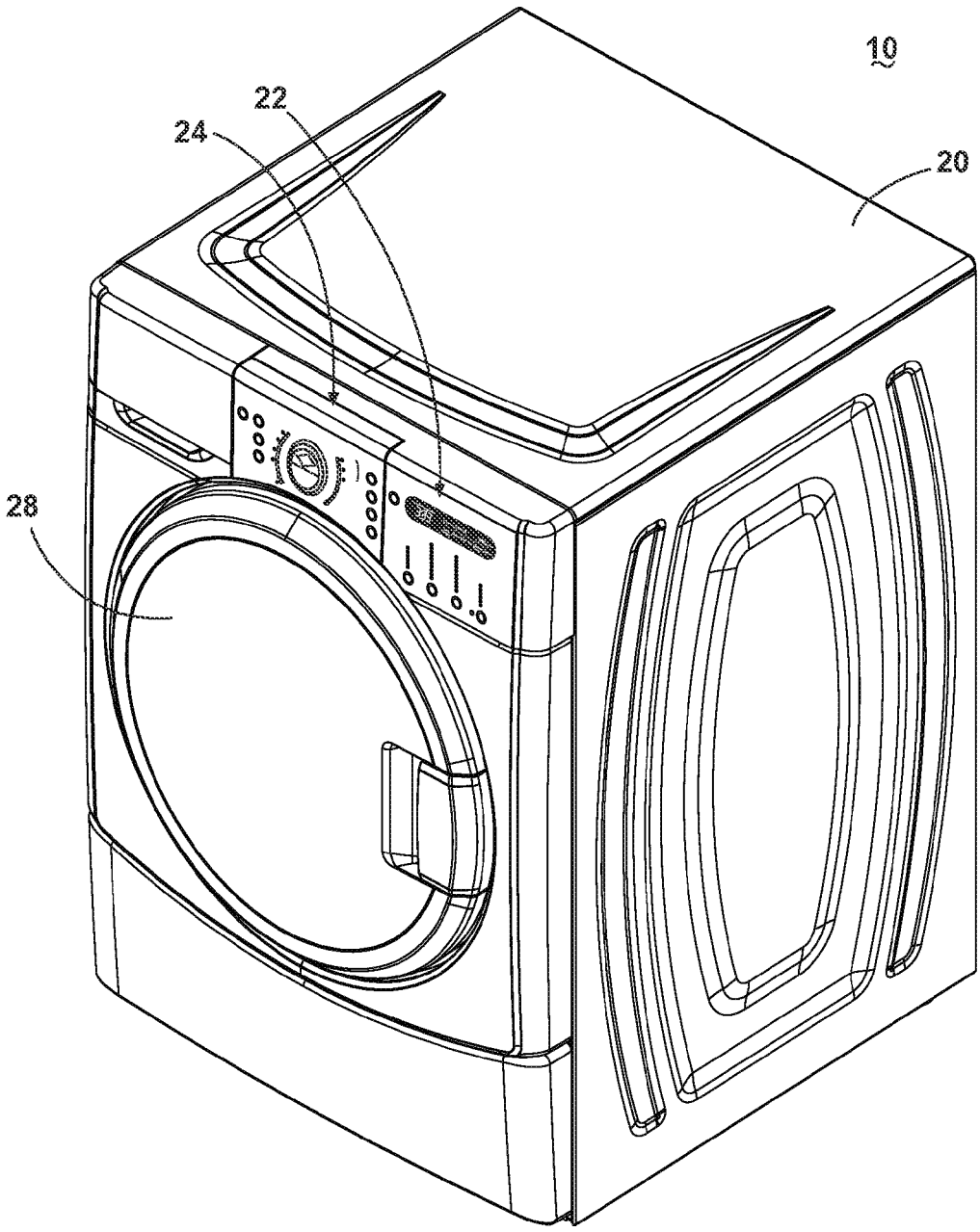
FIG. 2 is a perspective view of an exemplary laundry treating appliance in the form of a washing machine according to a second embodiment of the invention.

Referring now to FIG. 2, which is a perspective view of a laundry treating appliance in the form of a washing machine according to a second embodiment. As illustrated, the clothes washer 10 may have a cabinet 20 in which is provided a controller 22 that may receive an input from a user and/or provide information to a user through a user interface 24 for selecting a cycle of operation, including operating parameters for the selected cycle, and controlling the operation of the clothes washer 10 to implement the selected cycle of operation.

Figure 3:
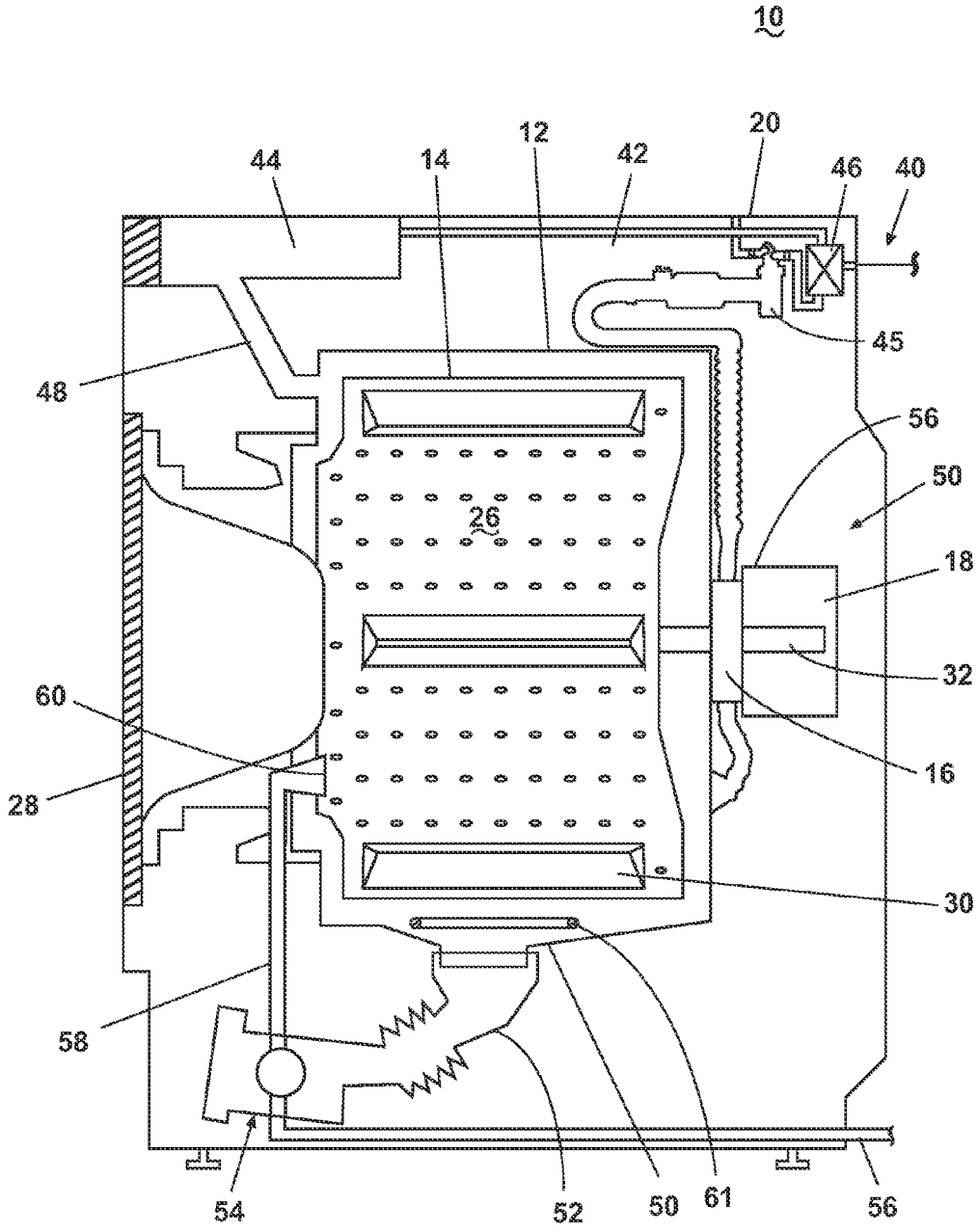
FIG. 3 is a schematic view of the washing machine of FIG. 2.

Referring now to FIG. 3, which is a schematic view of the laundry treating appliance 10 of FIG. 2, it is shown an imperforate tub 12 and a perforated drum 14 may be located within the interior of the cabinet 20. The tub 12 and the drum 14 may be mounted in the cabinet 20 such that the drum 14 can rotate relative to the tub 12. The drum 14 may define a wash chamber 26 for receiving laundry that has an open face that may be selectively closed by a door 28. The drum 14 further may have one or more baffles 30, which are sometimes referred to as lifters. The baffles 30 facilitate the tumbling action of the fabric load within the drum 14 as the drum 14 rotates about the rotational axis. Additionally, the interior surface of the drum 14 and/or the surface of the baffles 30 may be textured to increase a mutual friction between the drum 14 and laundry improving the mechanical action given to the laundry.

An automatic motor 18 may be coupled to the drum 14 via a drive shaft 32 to rotate the drum 14 at various speeds in either rotational direction. The motor 18 may be a direct drive motor, for example, a brushless permanent magnet (BPM) motor, an induction motor, a permanent split capacitor (PSC) motor, etc. Alternately, the motor 18 may be indirectly coupled with the drive shaft 32 via for example a belt, as is known in the art.

The washing machine 10 may further include a liquid supply and recirculation system. Liquid, such as wash aid, which is typically water, alone or in a mixture with other wash aids, may be supplied to the washing machine 10 from a water supply 40 in the case of water, such as a household water supply. A supply conduit 42 may fluidly couple the water supply 40 to a detergent dispenser 44. An inlet valve 46 may control flow of the liquid from the water supply 40 and through the supply conduit 42 to the detergent dispenser 44. A liquid conduit 48 may fluidly couple the detergent dispenser 44 with the tub 12. The liquid conduit 48 may couple with the tub 12 at any suitable location on the tub 12 and is shown as being coupled to a front wall of the tub 12 in FIG. 3 for exemplary purposes. The liquid that flows from the detergent dispenser 44 through the liquid conduit 48 to the tub 12 typically enters a space between the tub 12 and the drum 14 and may flow by gravity to a sump 50 formed in part by a lower portion of the tub 12. The sump 50 may also be formed by a sump conduit 52 that may fluidly couple the lower portion of the tub 12 to a pump 54. The pump 54 may direct fluid to a drain conduit 56, which may drain the liquid from the washing machine 10, or to a recirculation conduit 58, which may terminate at a recirculation inlet 60. The recirculation inlet 60 may direct the liquid from the recirculation conduit 58 into the drum 18. The recirculation inlet 60 may introduce the liquid into the drum 14 in any suitable manner, such as by spraying, dripping, or providing a steady flow of the liquid. A heating element 61 may be provided in the sump 50 to heat the liquid.

The liquid supply and recirculation system may further include one or more devices for heating the liquid; exemplary devices include sump heaters and steam generators. Additionally, the liquid supply and recirculation system may differ from the configuration shown in FIG. 3, such as by inclusion of other valves, conduits, wash aid dispensers, sensors, such as water level sensors and temperature sensors, and the like, to control the flow of liquid through the washing machine 10 and for the introduction of more than one type of detergent/wash aid. Further, the liquid supply and recirculation system need not include the recirculation portion of the system or may include other types of recirculation systems.

A steam generator 45 may be provided to supply steam to the treating chamber 26, either directly into the drum 14 or indirectly through the tub 12 as illustrated. The valve 46 may also be used to control the supply of water to the steam generator 45. The steam generator 45 is illustrated as a flow through steam generator, but may be other types, including a tank type steam generator. Alternatively, the heating element 61 may be used to generate steam in place of or in addition to the steam generator 45. The steam generator 45 is controlled by the controller 22 and may be used to heat to the laundry as part of a cycle of operation, much in the same manner as heating element 61. The steam generator 45 may also be used to introduce steam to treat the laundry as compared to merely heating the laundry.

In case of a dryer, an air flow system (not shown) is used, having a blower to first draw air across a heating element and into the drum, through a lint filter, and finally out through an exhaust conduit that is connected to an exhaust vent system leading out of the house.

Figure 4:
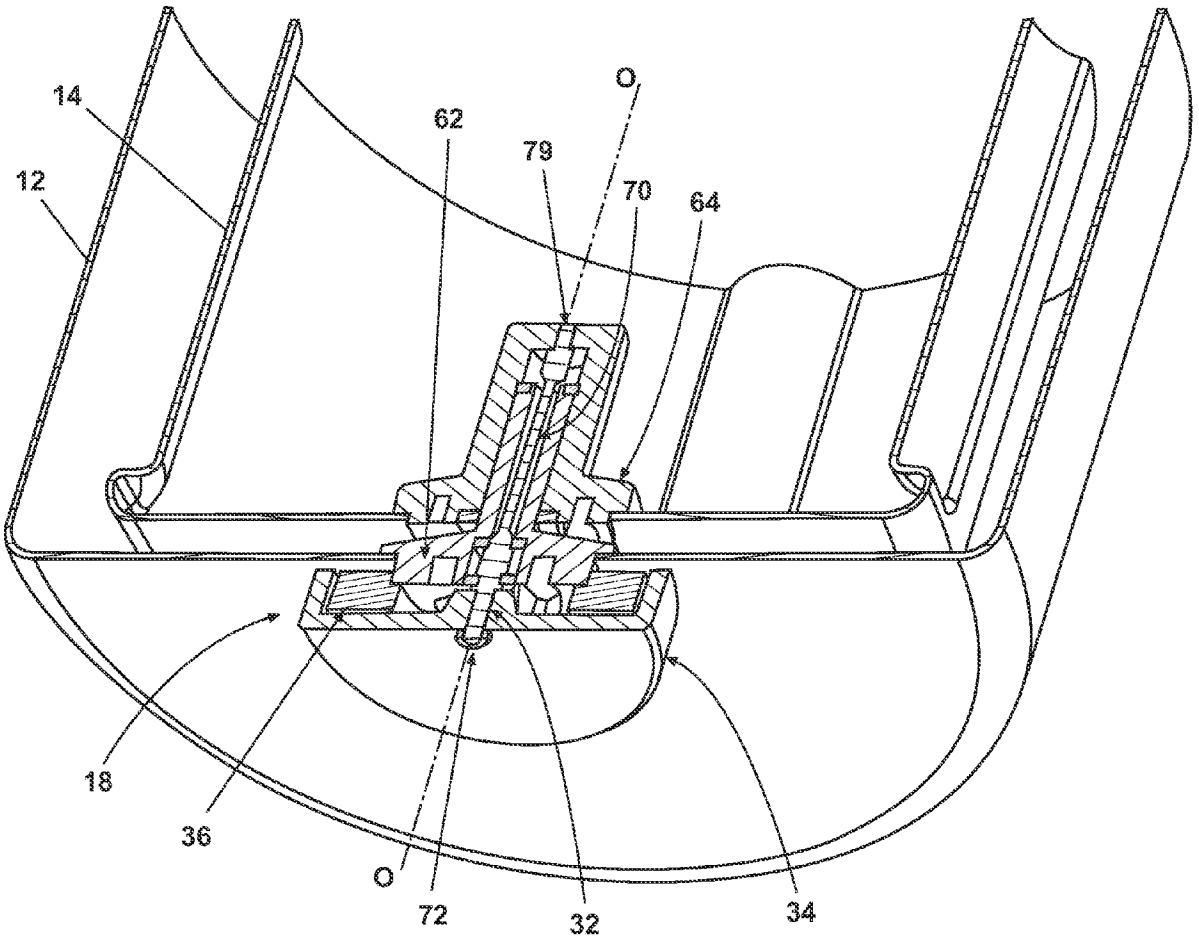
FIG. 4 is a perspective cross-sectional view of an oscillation mechanism and a motor according to a third embodiment of the invention.

Turning now to FIG. 4, an oscillation mechanism 16 is illustrated in a perspective cross-sectional view of the oscillation mechanism 16 and motor 18 according to a third embodiment of the invention. The illustrated motor 18 is a direct drive motor which may have a rotor 34 and a stator 36. A tub bearing 62 and a drum support 64 may also be provided as part of the rotational coupling of the drum 14 to the tub 12. The oscillating mechanism 16 according to one embodiment may be implemented as a rotationally, torsionally flexible drive shaft 32 coupling the motor 18 to the drum 14 via the drum support 64. The drive shaft 32 may be made of any material and design having a suitable torsional stiffness. High carbon steel is a non-limiting example of the suitable material. The torsional stiffness of the drive shaft 32 may be selected based on the anticipated combined inertia the drum 14 with the load of laundry and is a function of the drive shaft design. The washing machine is normally designed to wash laundry loads within a predetermined weight range, which can be used to select a torsional stiffness suitable for a particular washing machine. Other factors related to the anticipated inertial for the anticipated weight range may also be taken into account, for example, the radius of the drum and the mass of the drum.

As illustrated in FIG. 4, one method of setting the torsional stiffness is to control the cross section of the drive shaft 32. The drive shaft 32 has a reduced cross-sectional portion 70 between a first end of the drive shaft 72 coupled with the motor 18 and a second end of the drive shaft 74 coupled with the drum 14. This reduced cross-sectional portion 70 may provide a suitable torsional flexibility enabling the shaft 18 to act as the oscillating mechanism 16.

The controller 22 may be operably coupled with the motor 18 and the oscillating mechanism 16 and configured to supply a control signal to both the motor 18 and the oscillating mechanism 16 to effect the rotation of the drum 14. Alternatively, a separate controller (not shown) may be used to control an operation of the oscillating mechanism 16.

The controller 22 also may be a combination of a machine controller and motor controller within one physical location or a practical implementation may require their physical separation. The type and configuration of the controller 22 are not germane to the invention. Any suitable control system capable of outputting control signals to the motor 18 and to the oscillating mechanism 16 may be used. The controller 22 may be configured to supply a control signal to effect the rotation of the drum 14 about the axis of rotation O. The oscillation may be obtained by rotating the drum 14 in such a manner to induce oscillations in the drive shaft 32, with the oscillation generating the forces described by force vectors below.

Figure 5:
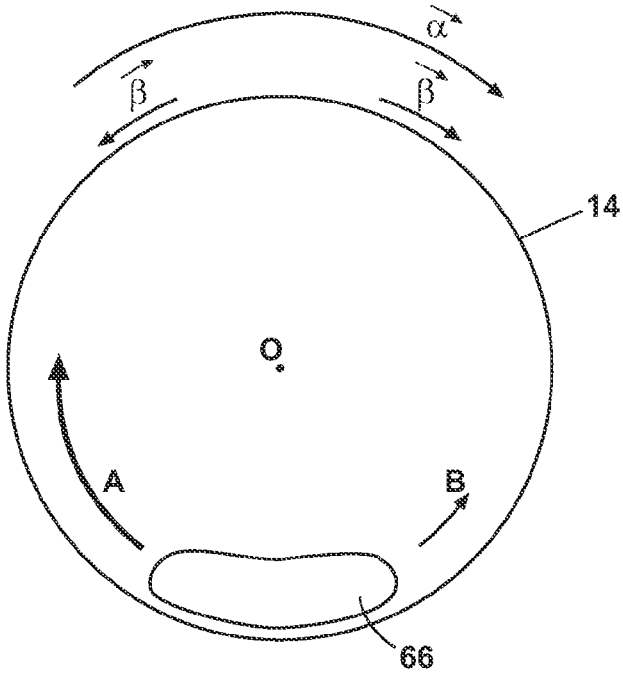
FIG. 5 is a schematic illustration of a complex rotation of a drum according to a fourth embodiment of the invention.

FIG. 5 schematically shows an oscillating rotation according to a fourth embodiment of the present invention. The illustrated rotation is a superimposed general rotation shown by a force vector α in the first rotational direction A and an oscillating rotation shown by a force vector β in alternating rotational directions A and B. The combination of these forces results in the rotation of the drum 14 in the direction A with slight oscillations between directions A and B. The magnitude of the force vector β is selected such that the overlying oscillations on the continuous rotation will impart to the laundry 66 in the drum a temporary force sufficient to overcome the frictional force between the laundry 66 and the drum to cause sliding movement of the laundry 66 in the directions A and/or B relative to the drum. This sliding movement of the laundry 66 provides a better mechanical cleaning action, especially if the interior surface of the drum 14 and/or the outer surface of the baffles 30 are textured.

The control signal from the controller 22 may be a composite signal of first and second superimposed signals, where the first signal effects the general rotation of the drum in the first rotational direction A and the second signal effects the oscillation of the drum about the axis of rotation O. The first signal may be selected to effect a predetermined operating speed of the drum 14 in accordance with a particular phase of the cycle of operation. The predetermined operating speed of the drum 14 may be, for example, a constant speed, an accelerating/decelerating speed, a tumbling speed, etc., or a combination of thereof. The second signal may be a sinusoidal wave form, a step wave form to cycle the motor 14 between ON and OFF states, a step wave form to cycle the motor 14 between a full motor torque and less than the full motor torque states, a signal accelerating and decelerating the motor 14, or other high frequency signals effecting the drum 14 to oscillate.

Figure 6:
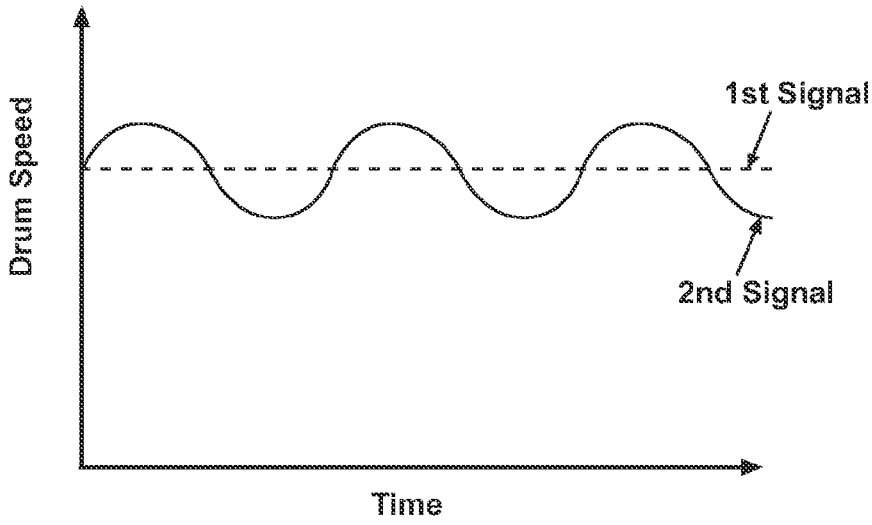
FIG. 6 is an example of a complex control signal according to the fourth embodiment of the invention.

FIG. 6 shows an example of a composite control signal superimposed of the first signal effecting the drum 14 to rotate at the a constant predetermined operating speed, and the second signal having a sinusoidal wave form effecting the drum 14 to oscillate about the axis of rotation O. This type of rotation may correspond to the rotation shown in the FIG. 5.

Figure 7:
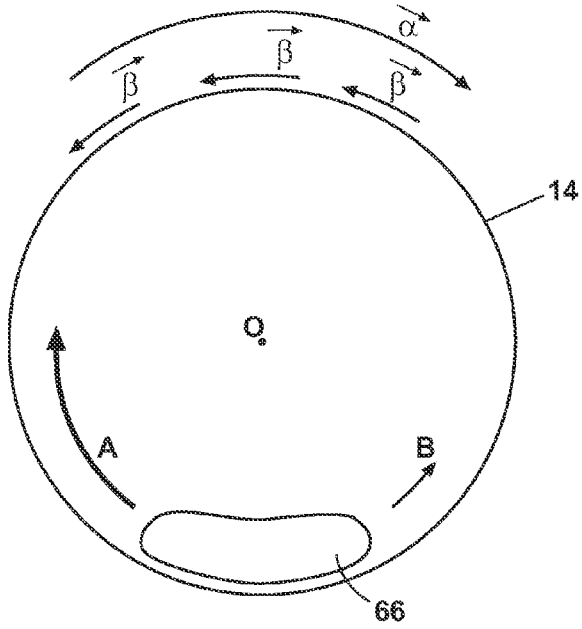
FIG. 7 is a schematic illustration of a complex rotation of a drum according to a fifth embodiment of the invention.

FIG. 7 schematically shows an oscillating rotation according to a fifth embodiment of the present invention. Similar to the fourth embodiment, the illustrated rotation is a superimposed general rotation shown by a force vector α in a first rotational direction A in combination with a repeating and discrete force vector β in a second rotational direction B. The combination of the two forces creates a type stutter rotation in the direction A. In other words, the general rotation in direction A with slight interruptions in the continuous rotation of the drum 14. The magnitude of the force vector β should be great enough such that the resulting interruptions in the continuous rotation will impart to the laundry 66 in the drum a temporary force sufficient to overcome the frictional force between the laundry 66 and the drum to cause sliding movement of the laundry 66 in the directions A and/or B relative to the drum.

Figure 8:
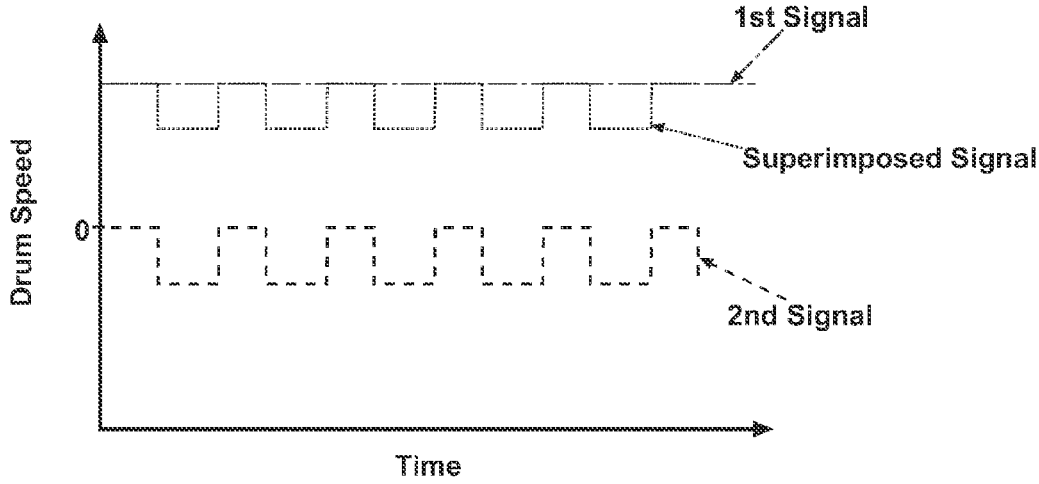
FIG. 8 is an example of a complex control signal according to the fifth embodiment of the invention.

FIG. 8 illustrates an example of a composite control signal superimposed of the first signal effecting the drum 14 to rotate at the a constant predetermined operating speed, and the second signal having a step wave form effecting the drum 14 to slightly stutter. The illustrated superimposed signal may correspond to the type rotation shown in the FIG. 7.

The drum 14 and the laundry load in the drum collectively define a system mass having a resonance frequency and the oscillation mechanism 16 may rotationally oscillate the mass at a rate sufficiently close to the resonance frequency to initiate the excitation of a resonance response of the system mass. In a case of the drum oscillation at the resonance frequency, a smaller amount of force is required to reach greater amplitude of the drum oscillation and a motor force feels only losses of that resonant system. The resonance of the system may occur at a natural frequency that is higher than the predetermined operating speed of the drum 14.

Similarly, the resonance may be excited by the controller 22 superimposing a force in the resonant frequency to the normal running forces of the motor 18. Using the resonance frequency will decrease an otherwise large force needed to rotate the drum 14. It will be understood, that it is within the scope of the present invention to use other types of oscillation mechanism 16 to enable slight interruptions/oscillations in the continuous rotation of the drum 14 about the axis of rotation O.

For example, the oscillation mechanism 16 may be embodied as a torsion spring system, defining a resonant system between the mass of the drum 14 and the mass of the rotor 34. When the oscillation mechanism 16 is embodied as a torsion spring system, the resonance frequency $f_0$ of the system may be based on the stiffness K of the drive shaft 70 and the inertia of the drum $J_D$ and rotor $J_R$ according to equation (1) below.

$$f_0 = \frac{1}{2\pi}\sqrt{K\frac{J_R + J_D}{J_R \times J_D}} \tag{1}$$

For example, for an exemplary washing machine where $J_D$=1.26 kg*m2, $J_R$=0.138 kg*m$^2$ and K of the drive shift is 529.8 N*m/rad, the resonance frequency of the system may be determined using equation (1) as 10.4 Hz. The determined resonance frequency can be used to apply a composite control signal in which a second signal, such as described above with respect to FIGS. 6 and 8, for example, is applied at a frequency of 10.4 Hz to effect an oscillation of the drum 14 about the axis of rotation O. It will be noted that the resonance frequency will vary from machine to machine and this example is meant to be illustrative and not limiting.

Figure 9:
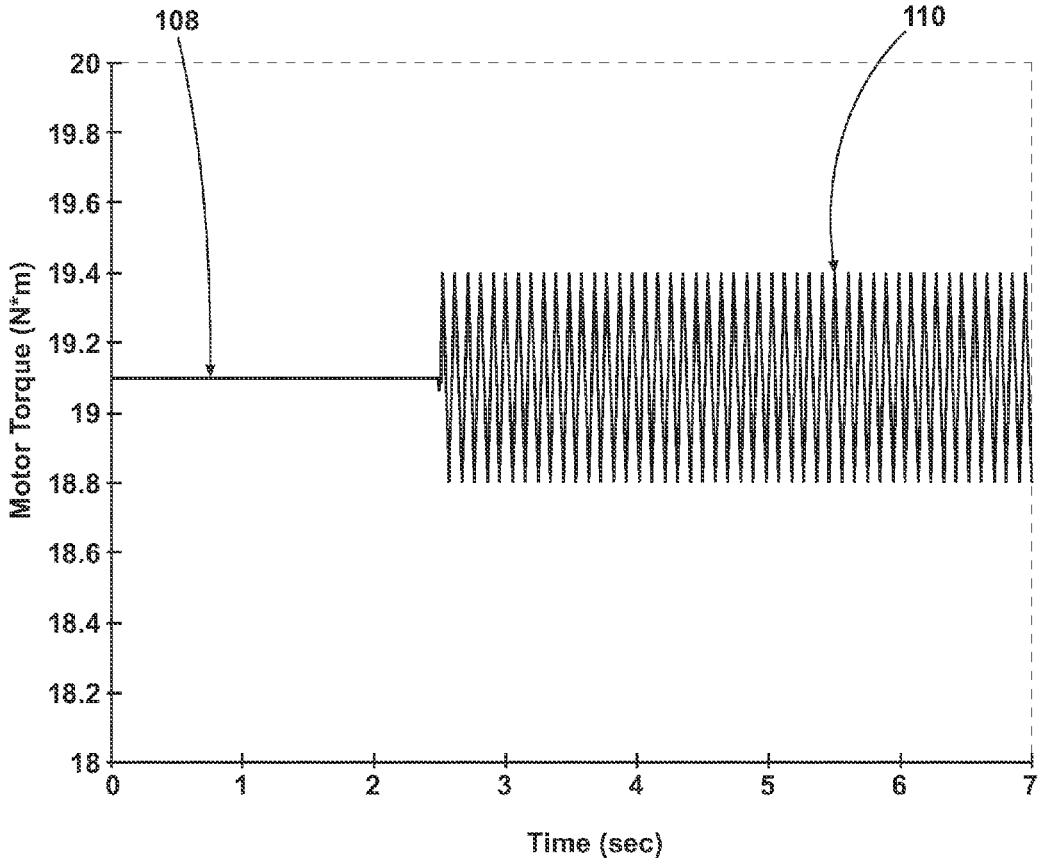
FIG. 9 is an illustration of a motor torque signal according to a sixth embodiment of the invention.
Figure 10:
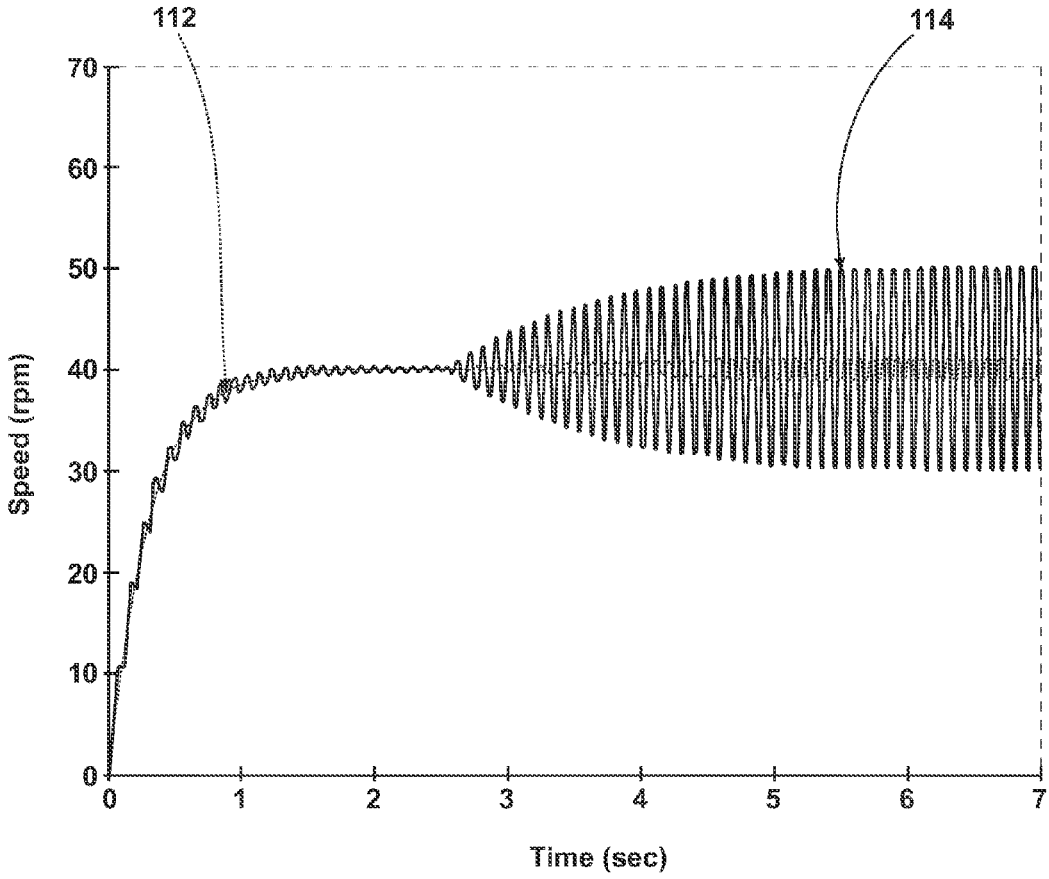
FIG. 10 is an illustration of a rotor speed and drum speed signal according to the application of the motor torque signal of the sixth embodiment of the invention.
Figure 11:
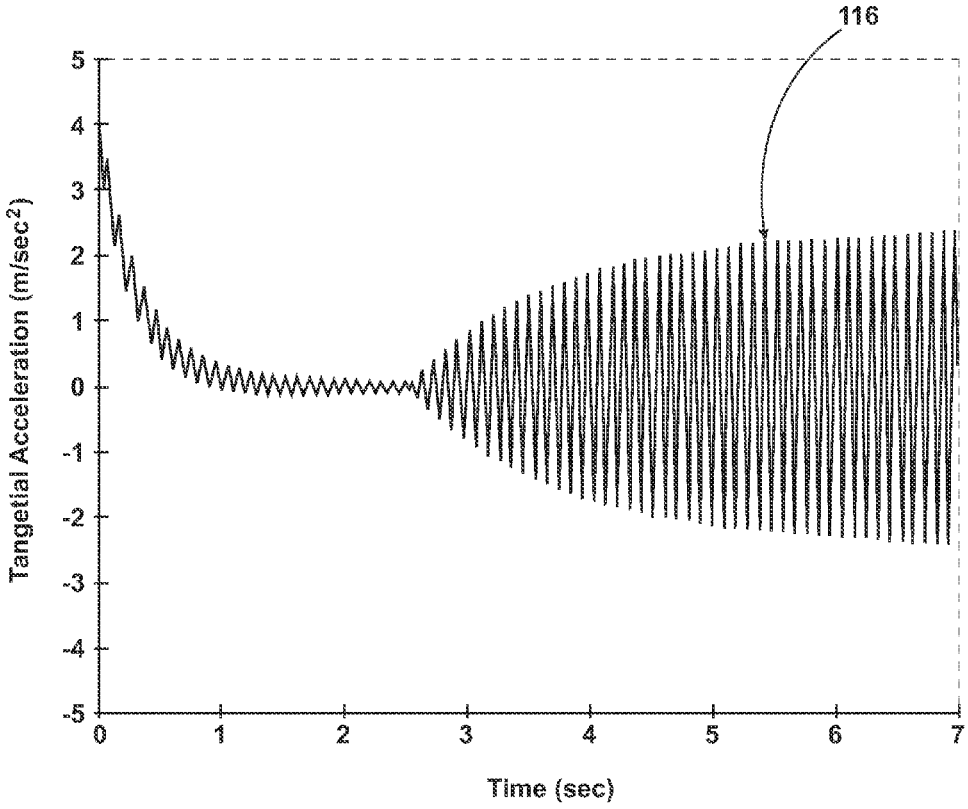
FIG. 11 is an illustration of a tangential acceleration force according to the application of the motor torque signal of the sixth embodiment of the invention.

The previously described washing machine 10 provides the structure necessary for the implementation of a method of applying mechanical energy to the load of laundry in the laundry treating appliance 10 with the controller 22 configured to supply the motor 18 with a composite control signal to control the applied torque. The controller 22 may supply the motor 18 with a composite signal including a first torque signal to rotate the drum 14 at a predetermined operating speed and a second torque signal to apply an oscillating rotational force. An exemplary method 100 will now be described as illustrated by FIGS. 9-11. FIGS. 9-11 are not necessarily indicative of real data and are for illustrative purposes only for the purpose of describing an embodiment of the invention and are not meant to limit the invention in any manner.

As discussed above, the drum 14 and rotor 34 may be considered as defining a resonant system in which the resonance frequency $f_0$ of the system may be determined based on equation (1). The controller 22 may use the determined resonance frequency to determine a frequency at which to apply the second signal in the form of a dynamic torque to the drum 14. For example, the controller 22 may use the resonance frequency to determine a frequency at which to apply a sinusoidal torque signal. The mass of the rotor 34 may be predetermined and stored in a memory accessible by the controller 22 and used to determine the inertia $J_R$ of the rotor 34. The inertia of the drum 14 may be determined at any point during a cycle of operation after the laundry has been placed in the drum 14 using any known method, non-limiting examples of which include determining the time it takes to accelerate between two predetermined speeds under a constant applied torque, determining the time to decelerate from a first speed to a second speed and measuring the torque required to rotate a load at a predetermined constant speed.

The amplitude of the dynamic torque signal may be selected by the controller 22 to provide a predetermined maximum tangential acceleration $a_t$ to effect the sliding movement of the laundry within the drum 14. The laundry may be excited to slide within the drum 14 if the force to move the laundry relative to the drum $F_{at}$ is greater than the frictional force between the laundry and the drum $F_{friction}$. $F_{at}$ is equal to the tangential acceleration $a_t$ times the mass of the laundry and $F_{friction}$ is equal to the fabric friction constant μ times the acceleration a and mass of the laundry, the acceleration being equal to the maximum vertical acceleration due to gravity and the centrifugal acceleration. The fabric friction constant μ may be determined experimentally or empirically for different types of fabric such as cotton, silk and denim, for example, and stored within a memory accessible by the controller 22. The type of fabric comprising the load may be determined manually, such as by user input through a user interface, or automatically by the washing machine 10 according to any known method, such as based on the absorbency of the load, for example.

FIG. 9 illustrates an example of a motor torque signal in which a sinusoidal torque signal 110 is applied. As illustrated in FIG. 9, a first, constant motor torque signal 108 of approximately 19.1 N*m is applied to rotate the drum 14 in a first direction, such as clockwise, for example, at a predetermined operating speed. Any suitable motor torque magnitude may be selected to rotate a given load at a desired predetermined speed based on one or more operating parameters such as the selected operating cycle, the amount of laundry and the type of laundry and/or one or more characteristics of the system such as the size of the drum 14, the size of the motor 18 and the stiffness of the drive shaft 70, for example. At approximately 2.5 seconds a dynamic torque signal in the form of a sinusoidal torque signal 110 having an amplitude of approximately 0.3 N*m is applied to the motor 18. The sinusoidal torque signal 110 may be applied at any suitable time during a course of operation. The sinusoidal torque signal 110 results in rotation of the drum 14 in the first direction with slight oscillations between the first direction and a second direction opposite the first. For example, if the drum 14 is rotating clockwise due to the application of a constant motor torque, the application of a sinusoidal torque signal results in the drum rotating clockwise with slight clockwise and counter-clockwise oscillations.

The amplitude of the applied sinusoidal torque signal 110 may be determined as described above based on the mass and type of fabric of the laundry. The frequency of the sinusoidal torque signal 110 may be selected based on the stiffness K of the drive shaft 70 and the inertia of the drum $J_D$ and rotor $J_R$ as discussed above with reference to equation (1) to generate resonance between the rotor 34 and the drum 14. Generating resonance between the rotor 34 and the drum 14 may result in less force being required to achieve a predetermined amplitude of drum oscillation.

As illustrated in FIG. 10, the sinusoidal torque signal 110 results in oscillation of the rotor 34 in alternating directions, which results in oscillation of the rotor speed above and below a set rotation speed as illustrated by rotor speed signal 112. As illustrated in FIG. 10, the speed of the rotor 34 is brought up to approximately 40 rpm as a result of the applied constant motor torque 108 and the application of the sinusoidal torque signal 110 around 2.5 sec results in an oscillation of the rotor speed above and below 40 rpm. The oscillations of the rotor 34 may be transferred through the drive shaft 70 to the drum 14 which causes the drum 14 to rotate at approximately 40 rpm with slight oscillations above and below 40 rpm as illustrated by drum speed signal 114. The application of the sinusoidal torque signal 110 near the resonance frequency of the system may provide a more efficient transfer of the sinusoidal torque signal 110 through the rotor 34 to the drum 14 such that a smaller alternating torque is required to oscillate the drum 14 than may be necessary if the sinusoidal torque signal was applied at a frequency not near the resonance frequency of the system.

FIG. 11 illustrates a tangential acceleration signal 116 representative of a tangential acceleration that may be experienced by a laundry load in the drum 14 when the drum 14 is rotated according to the torque signals 108, 110 illustrated in FIG. 9. In this example, the maximum tangential acceleration experienced by the laundry load as a result of the applied sinusoidal torque signal 110 is approximately 2.35 $m/s^2$. As discussed above, if the maximum tangential acceleration of 2.35 $m/s^2$ provides an $F_{at}$ larger than the $F_{friction}$ between the laundry load and the interior of the drum 14, then the laundry load may slide within the drum 14 as the drum 14 is rotated and oscillated. This sliding movement of the laundry load may provide an improved mechanical cleaning action.

The dynamic torque signal may be applied one or more times at any suitable time during the course of a cycle of operation to provide sliding movement of the laundry load relative to the drum 14 to improve the mechanical cleaning action during a course of operation. The method 100 may also be used to apply the dynamic torque signal as a step wave form, similar to that described with respect to FIGS. 7 and 8.

While the method 100 is described as generating a dynamic torque signal 110 at the resonance frequency of the system based on equation (1), it is also within the scope of the invention for the dynamic torque signal to be generated at a frequency based on a harmonic of the drum rotation frequency. For example, if the drum 14 is rotating at 40 rpm or 0.667 Hz, the frequency for generating a dynamic torque signal may be the $14^{th}$ harmonic or approximately 10 Hz. Alternatively, an independent frequency may be superimposed on the torque signal.

It is also within the scope of the invention for the controller 22 to monitor the amplitude of the rotor oscillations and adjust the frequency of the applied dynamic torque signal to achieve a desired amplitude. The amplitude of the rotor oscillations may be determined based on the back EMF from the motor or the current fluctuation. The controller 22 may also use the determined amplitude to determine when resonance starts or when the amplitude is at a maximum. This information may then be used by the controller 22 to set one or more operating parameters, such as how long to apply the dynamic torque signal or when to apply a treatment chemistry, for example.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance configured to implement a cycle of operation to treat a load of laundry, comprising:

a drum defining a treating chamber and rotatable about an axis of rotation;

a motor having a rotor;

a torsionally flexible drive mechanism coupling the rotor with the drum such that rotation of the motor effects a rotation of the drum, the drive mechanism having a predetermined resonance frequency; and a controller operably coupled with the motor and configured to supply a control signal to the motor to effect a rotation of the drum via the torsionally flexible drive mechanism comprising a simultaneous general rotation in a first rotational direction about the axis of rotation and a resonance oscillation of the drive mechanism at the predetermined resonance frequency about the axis of rotation to repeatedly generate a tangential acceleration to overcome a frictional force between the laundry and the drum to effect a sliding movement of the laundry relative to the drum.

2. The laundry treating appliance of claim 1 wherein the drive mechanism comprises a flexible drive shaft.

3. The laundry treating appliance of claim 2 wherein the drive shaft has a predetermined torsional stiffness that is selected based on a combined inertia of the drum and the load of laundry.

4. The laundry treating appliance of claim 2 wherein the drive shaft comprises a reduced cross-sectional portion between a first end of the drive shaft coupled with the motor and a second end of the drive shaft coupled with the drum.

5. The laundry treating appliance of claim 1 wherein the control signal comprises a composite signal of first and second superimposed signals, where the first signal effects the general rotation of the drum and the second signal effects the resonance oscillation of the drive mechanism about the axis of rotation.

6. The laundry treating appliance of claim 5 wherein the first signal effects a rotation of the drum at a tumbling speed.

7. The laundry treating appliance of claim 5 wherein the second signal comprises a sinusoidal wave form.

8. The laundry treating appliance of claim 5 wherein the second signal comprises a step wave form to cycle the motor between ON and OFF states.

9. The laundry treating appliance of claim 5 wherein the second signal accelerates and decelerates the motor.

10. The laundry treating appliance of claim 1 wherein the resonance oscillation about the axis of rotation comprises rotation between the first rotational direction and a second rotational direction, opposite the first rotational direction.

* * * * *